United States Patent [19]

Feldeisen et al.

[11] 4,060,105

[45] Nov. 29, 1977

[54] TONER LOADING APPARATUS WITH REPLENISHING SUPPLY CONTAINER

[75] Inventors: Ronald F. Feldeisen, Fairport; John A. Minchak, Wesbter, both of N.Y.; Richard B. Gerstman, Tenafly, N.J.; Herbert M. Meyers, New Rochelle; Richard C. Edstrom, New York, both of N.Y.

[73] Assignee: Xerox Corporation, Stamford, Conn.

[21] Appl. No.: 734,787

[22] Filed: Oct. 22, 1976

Related U.S. Application Data

[63] Continuation of Ser. No. 612,529, Sept. 11, 1975.

[51] Int. Cl.[2] ..... B65B 1/06

[52] U.S. Cl. ..... 141/1; 141/363; 222/325; 222/DIG. 1

[58] Field of Search ..... 141/363–366, 141/1; 222/DIG. 1, 325, 386.5, 215, 206

[56] References Cited

U.S. PATENT DOCUMENTS

| | | | |
|---|---|---|---|
| 3,147,890 | 9/1964 | Mittelsteadt | 222/325 X |
| 3,249,262 | 5/1966 | Barr et al. | 222/386.5 X |
| 3,526,341 | 9/1970 | Johnston | 222/325 |
| 3,915,208 | 10/1975 | Anderson | 222/DIG. 1 |

*Primary Examiner*—Robert B. Reeves

*Assistant Examiner*—David A. Scherbel

*Attorney, Agent, or Firm*—Earl T. Reichert

[57] ABSTRACT

To add toner to the toner hopper of an electrostatic reproduction machine without contaminating either the operator or the interior of the machine, an improved toner bottle and receiver coact so as to eliminate or minimize the danger of generating toner clouds or spilling toner during the loading operation. The bottle has a body and a cap rotatably mounted on one end of the body. The body has a plurality of locating and locking lugs which coact with corresponding channels in the receiver so that the bottle can be inserted into the receiver in only one position. When a closed toner bottle is inserted into the receiver, a lip serves both to position the cap relative to an inlet opening of the receiver, and to retain the cap in this position as the body is rotated so that openings in the body and cap are aligned with the inlet opening; a suitable mechanism stops the body when the three openings are aligned. As the body is rotated, the bottle is simultaneously locked onto the hopper by the lugs being moved out of alignment with their corresponding channels. After being locked onto the hopper a bellows portion of the body is compressed to expel toner into the hopper. In order to remove the bottle from the hopper, it must be returned to its initial position which also closes the bottle.

5 Claims, 5 Drawing Figures

TONER LOADING APPARATUS WITH REPLENISHING SUPPLY CONTAINER

This is a continuation, of application Ser. No. 612,529, filed Sept. 11, 1975.

BACKGROUND OF THE INVENTION

This invention relates to apparatus for and a method of adding toner to the toner hopper of an electrostatic reproduction machine.

In conventional xerography, a xerographic surface comprising a layer of photoconductive insulating material affixed to a conductive backing is used to support electrostatic latent images. In the process, the xerographic surface is electrostatically charged, and the charged surface is then exposed to a light pattern of the image being reproduced to thereby discharge the surface in the areas where light strikes the surface. The undischarged areas of the surface thus form an electrostatic charge pattern (the latent image) conforming to the original pattern.

The latent image is then developed by contacting it with a finely divided electrostatically attractable powder referred to as toner. The toner is held on the image areas by the electrostatic charge on the photoconductive layer. Where the charge is greater, the greater amount of toner is deposited. Thus, a toner image is produced in conformity with a light image of the copy being reproduced. Generally, the developed image is then transferred to a suitable transfer member and affixed thereto to form a permanent record of the original document.

The latent image is developed by a suitable developer such as a magnetic brush developer. During the reproduction process, the toner in the developer is depleted. Thus, additional toner is periodically automatically dispensed into the developer by a toner hopper. Consequently, toner must also be added periodically to the toner hopper. Prior art arrangements for adding toner into a toner hopper require that toner be poured out of a container into the hopper; there are no connections between the container and the hopper. Toner is generally black and of small particle size. Unless extreme precaution is taken in pouring the toner, a cloud of fine toner is produced and toner is invariably deposited on the hands and clothing of the operator. This is highly undesirable because the powder is difficult to remove because of its small particle size. Also, in attempting to empty all of the toner from the toner container into the toner hopper, the operator may have to shake the toner container and/or tap the toner container against the toner hopper. This may result in spilling toner on the inside of the reproduction machine and in generating additional toner clouds, thus contaminating the interior of the reproduction machine.

Another prior art arrangement utilizes a toner bottle combined with a flexible conduit, the latter being connected to the toner bottle and to the toner hopper. The toner bottle is uprighted, and the toner passes through the conduit into the toner hopper. Like the above described arrangement this arrangement is also time consuming in that the toner bottle must still be shaken in attempting to empty all of its contents into the toner hopper. Also, if the hopper is filled before all of the contents of the toner bottle have been emptied, the operator is faced with the problem of disconnecting the conduit from the toner hopper without spilling toner within the machine. The toner contained within the conduit is almost invariably spilled on internal machine parts and/or the operator, thus producing the same contamination described above.

Thus, what is needed is an arrangement whereby toner can be quickly added to the toner hopper. The apparatus should be simple, easy to use, and should eliminate or minimize the danger of contaminating the inside of the reproduction machine or the operator.

SUMMARY OF THE INVENTION

Accordingly, it is an object of the present invention to provide an arrangement whereby toner can be easily and simply added to a toner hopper.

It is also an object of the present invention to provide a toner bottle whereby all, or essentially all, of the toner can be easily removed from the bottle, assuming that the toner hopper is capable of receiving all of the toner.

It is also an object of the present invention to eliminate or minimize the danger of contaminating the machine or the operator in the event the toner hopper is filled before all of the toner is emptied from the toner bottle.

The present invention includes a toner bottle having a body, the body having an outlet opening at one end thereof through which toner is added to a toner hopper of an electrostatic reproduction machine. The body is formed of resilient material, and has a portion in the form of a bellows. Rotatably mounted on one end of the body is a dispensing cap having an opening conforming generally in size and shape to the outlet opening, in the body. The dispensing cap can be rotated to an open position where its opening is aligned with the outlet opening, or to a closed position where its opening is moved out of alignment with the outlet opening. The bottle contains a plurality of locating lugs around it periphery, all of the lugs except one being the same size. Mounted on top of the toner hopper in the electrostatic reproduction machine is a receiver for receiving the bottle, the receiver having a neck which has a plurality of locating channels formed therein, the channels corresponding in number, location, and size to the locating lugs on the bottle. Consequently, the toner bottle can be inserted into the neck in only one position.

Mounted against a bottom wall at the inner end of the neck of the receiver is an annular seal against which the dispensing cap abuts when the toner bottle has been moved into the neck and locked therein by rotating the locating lugs out of alignment with the corresponding locating channels. Being closed when inserted into the neck, the bottle cannot be opened until the locating lugs are rotated out of alignment with their corresponding locating channels. A lip conforming generally in size and shape to the opening in the dispensing cap extends from the bottom wall, the lip surrounding an inlet opening through which toner enters the toner hopper. The lip mates with and extends into the opening in the cap whereby the latter is held in place while the body of the bottle is rotated to lock the bottle onto the hopper. Rotation of the body of the bottle is stopped when a stopping lug thereon abuts a stop on the neck; when this occurs the bottle is in its fully open position. Thus, once the bottle has been inserted into the neck and rotated to its fully open position, it cannot be removed from the neck until it has been moved to its fully closed position once again. After the bottle has been moved to its fully open position, the bellows is compressed several times to expel toner into the toner hopper. To fully close the bottle and remove it from the neck, the body is rotated back to the position where the locating lugs are aligned with their corresponding locating channels. The toner bottle can now be removed from the neck without danger of spillage or contamination. A plurality of openings are formed in the neck and bottom wall of the receiver for permitting any excess toner to drain into the toner hopper upn removal of the toner bottle from the neck.

DESCRIPTION OF THE PREFERRED EMBODIMENT

Figure 1:
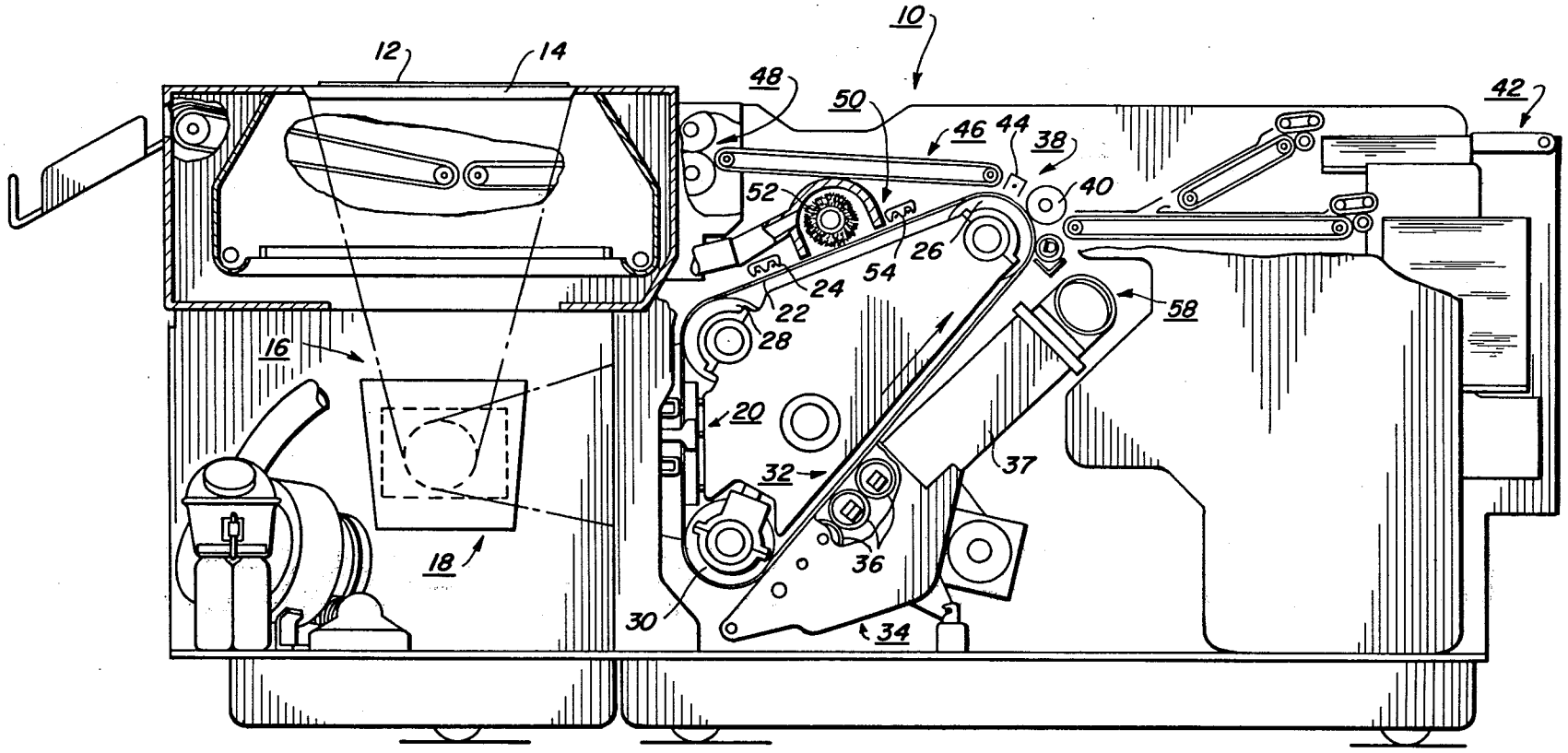
FIG. 1 is a schematic view of an electrostatic reproduction machine embodying the principles of the present invention.

For a general understanding of an electrostatic processing system in which the invention may be incorporated, reference is made to FIG. 1. As in all electrostatic reproduction machines of the type illustrated, a light image of an original to be reproduced is projected onto the sensitized surface of a xerographic plate to form an electrostatic latent image thereon. Thereafter, the latent image is developed with an oppositely charged developing material comprising carrier beads and smaller toner particles triboelectrically adhering thereto to form a xerographic powder image corresponding to the latent image of the plate surface. The powder image is then electrostatically transferred to a support surface to which it may be fixed by a fusing device whereby the toner image is caused permanently to adhere to the support surface.

In the illustrated machine 10, an original 12 to be copied is placed upon a transparent support platen 14 fixedly arranged in an illumination assembly generally indicated by the reference numeral 16. While upon the platen, an illumination system flashes light rays upon the original, thereby producing image rays corresponding to the informational areas on the original. The image rays are projected by means of an optical system 18 to an exposure station 20 for exposing the photosensitive surface of a moving xerographic plate in the form of a flexible photoconductive belt 22. In moving in the direction indicated by the arrow, prior to reaching the exposure station 20, that portion of the belt being exposed would have been uniformly charged by a corona device 24 located at a belt run extending between belt supporting rollers 26 and 28. The exposure station extends between the roller 28 and a third support roller 30.

The exposure of the belt surface to the light image discharges the photoconductive layer in the areas struck by light, whereby a latent electrostatic image is produced on the belt in image configuration corresponding to the light image projected from the original on the supporting platen. As the belt surface continues its movement, the electrostatic image passes around the roller 30 and through the developing station 32 located at a third run of the belt in which there is positioned a developing apparatus or developer generally indicated by the reference numeral 34. The developing apparatus 34 comprises a plurality of magnetic brushes 36 which carry developing material to the adjacent surface of the upwardly moving inclined photoconductive belt 22. As the developing material is applied to the xerographic belt, toner particles in the development material are attracted electrostatically to the belt surface to form powder images. During the reproduction process, toner is periodically automatically dispensed into the developer 34 by a toner hopper 37 via any conventional means such as a foam roller.

The developed electrostatic image is transported by the belt 22 to a transfer station 38 located at a point of tangency on the belt as it moves around the roller 26 where a sheet of copy paper is moved in synchronism with the moving belt in order to accomplish transfer of the developed image. A transfer roller 40 at the transfer station is arranged on the frame of the machine to contact the non-transfer side of each sheet of copy paper as the latter is brought into transfer engagement with the belt 22. The roller 40 is electrically biased with sufficient voltage so that a developed image on the belt may be electrostatically transferred to the adjacent side of a sheet of paper as the same is brought into contact therewith.

Also provided is a suitable sheet transport mechanism adapted to transport sheets of paper seriatim from a paper handling mechanism generally indicated by the reference numeral 42 to the developed image on the belt as the same is carried around the roller 26. A programming device operatively connected to the mechanism 42, and to the illumination device, is effective to present a developed image at the transfer station 38 in timed sequence with the arrival of a sheet of paper.

As the sheet emerges from the transfer roller, it is influenced by a detacking corona discharge device 44 so as to lessen the electrostatic attraction between the sheet and the belt. The sheet is thereafter retained on the underside of a transport mechanism 46 by suitable means such as vacuum for movement into a fuser assembly generally indicated by the reference numeral 48 wherein the developed and transferred xerographic powder image on the sheet is permanently affixed thereto. After fusing, the finished copy is discharged from the apparatus at a suitable point for the collection externally of the apparatus. The toner particles remaining as residue on the developed image, background particles, and those particles otherwise not transferred are carried by the belt 22 to a cleaning apparatus 50 positioned on the run of the belt between the rollers 26 and 28 adjacent to the charging device 24. The cleaning apparatus comprises a rotating brush 52 and a corona discharge device 54, for neutralizing charges remaining on the particles.

Figure 2:
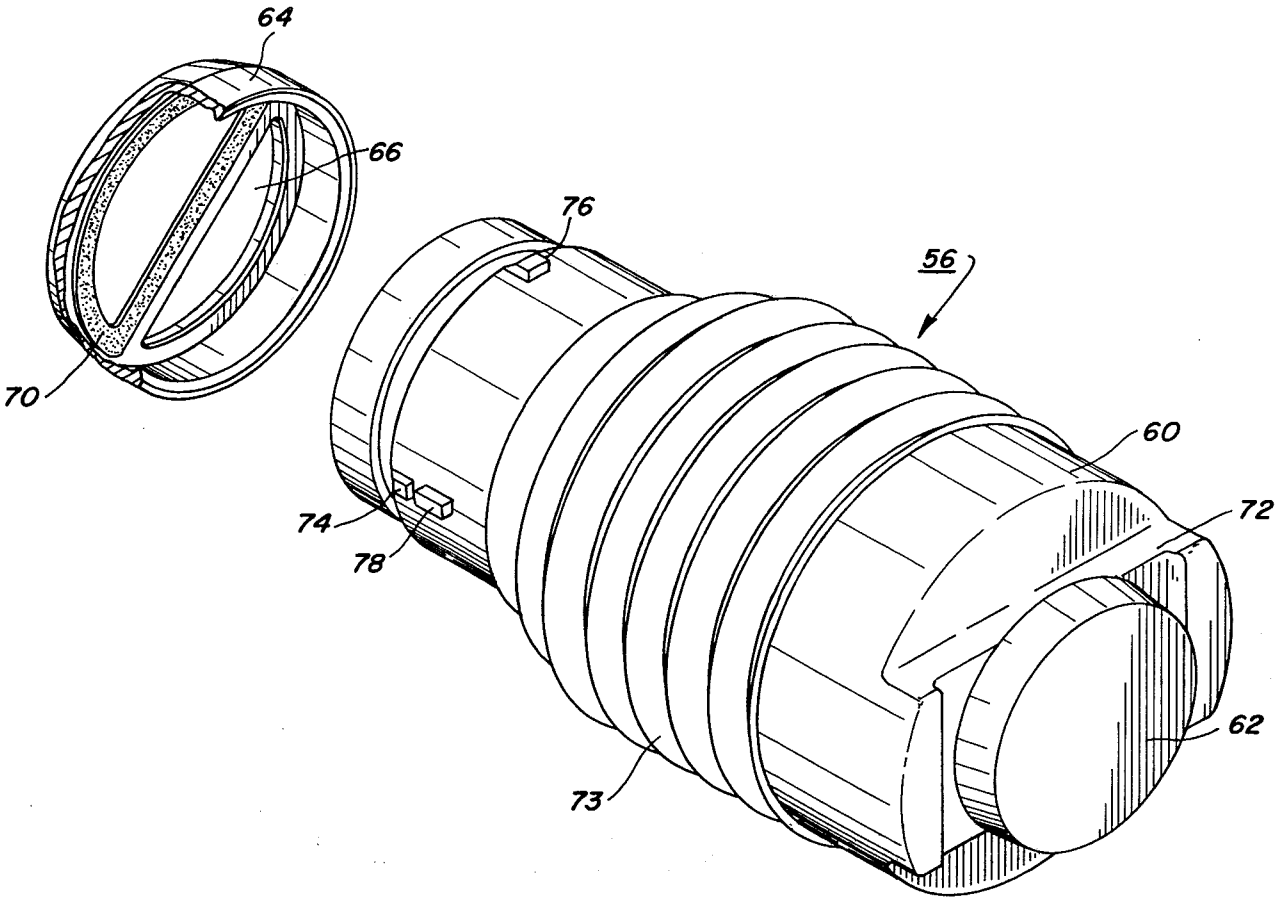
FIG. 2 is a perspective view of the toner bottle with the dispensing cap removed so that the seal mounted therein can be seen.
Figure 3:
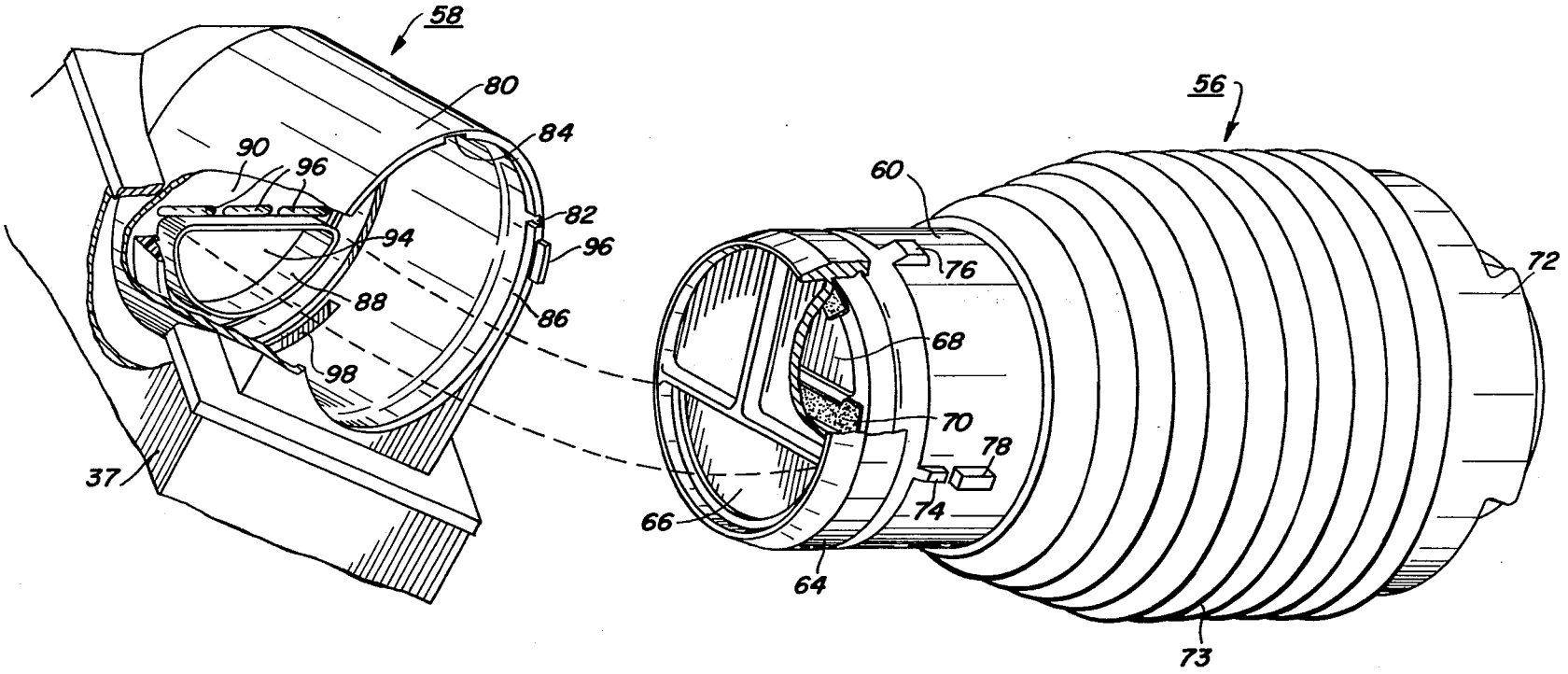
FIG. 3 is a perspective view of the toner bottle and the receiver.

Referring now to FIGS. 2 and 3, the apparatus for adding toner to the toner hopper 37 is illustrated. This apparatus includes a toner bottle 56 which is adapted to coact with a receiver 58 on top of the toner hopper 37. The bottle 56 includes a one-piece blow-molded body 60 made of low density polyethylene, a removable filling cap 62, and a dispensing cap 64 which is rotatably mounted on the dispensing end of the body. The dispensing cap 64 is a one piece injection molded member made of Acrylonitrile-Butadriene-Styrenene. As can be seen, the dispensing cap 64 has a D-shaped opening 66 which conforms generally in shape and size to a D-shaped outlet opening 68 in the end of the body 60.

When the openings 66 and 68 are in the position shown in FIG. 3, a seal 70 of polyethylene foam surrounds the outlet opening 68, and the bottle is fully closed and sealed. When the body 60 is rotated 180° with respect to the dispensing cap 64 from the position shown in FIG. 2, the two openings 66 and 68 will be in alignment and the bottle is fully open. At the filling end of the toner bottle 56, the body is formed so as to produce a handle 72 with which to grasp the bottle while adding toner to the toner hopper 37. The central portion of the body 60 is formed as a bellows 73, the purpose of which will be explained hereafter. Near the dispensing end of the toner bottle 56 are two locating lugs 74 of identical size, and a third, but larger locating lug 76. A stopping lug 78 is located immediately behind one of the locating lugs 74.

To add toner to the hopper 37, the bottle 56 is inserted into the neck 80 of the receiver 58 by aligning the locating lugs 74 with locating channels 82, and the locating lug 76 with the locating channel 84. Channels 82 and 84 are formed in an annular rim 86, and respectively correspond in size and location to the locating lugs 74 and 76. Thus, it can be seen that the bottle 56 can be inserted into the receiver 58 in only one position. The bottle 56 is then moved inwardly until the D-shaped lip 88 extending from a bottom wall 90 moves into the D-shaped opening 66 in the dispensing cap 64 and the end of the cap 64 abuts an annular rubber seal 92. As can be seen, the D-shaped lip 88 surrounds a D-shaped inlet opening 94 in the bottom wall 90, through which inlet opening toner is added to the toner hopper 37. To lock the toner bottle 56 in abutting relation to the annular seal 92 and onto the toner hopper 37, the body 60 is rotated 180° in a clockwise direction until the stopping lug 78 contacts a stop 96. In this position, the bottle is fully opened, i.e., the openings 66 and 68 are aligned. During rotation of the body 60, the dispensing cap 64 is held in a stationary position by the D-shaped lip 88.

Toner is now expelled from the bottle 56 into the hopper 37 by grasping the handle 72, pushing inwardly to compress the bellows 73; and releasing the pressure to allow the bellows to expand. This procedure is repeated several times until all, or substantially all of the toner has been forced into the toner hopper 37. The toner hopper has a suitable filtered opening (not shown) which allows the hopper to "breath", i.e., to permit air to be expelled when the bellows 73 is compressed, and to premit air to enter the hopper when the bellows is released; the filter prevents toner from being expelled from the hopper with the air. In addition to holding the dispensing cap 64 in a stationary position during rotation of the body 60, the D-shaped lip 88 also serves to guide the toner from the bottle into the hopper. Tests have shown that more than 99% of the toner is consistently expelled from the bottle utilizing this apparatus. This assumes that the toner hopper 37 is able to receive all of the contents of the bottle 56.

When the toner bottle 56 has been emptied, or when the toner hopper 37 has been filled and is incapable of accepting any more toner, the handle 72 is grasped and the body 60 is rotated in a counterclockwise direction until the locating lugs 74 and 76 are aligned with their corresponding locating channels 82 and 84 respectively. In this position the bottle is once again fully closed as shown in FIG. 3 and can be safely removed from the receiver 58. Any minor amount of toner which may be present within the receiver 58 as the bottle is being withdrawn drains into the toner hopper 37 via openings 96 formed in the bottom wall 90 of the receiverand openings 98 formed in neck 80 of the receiver.

Figure 5:
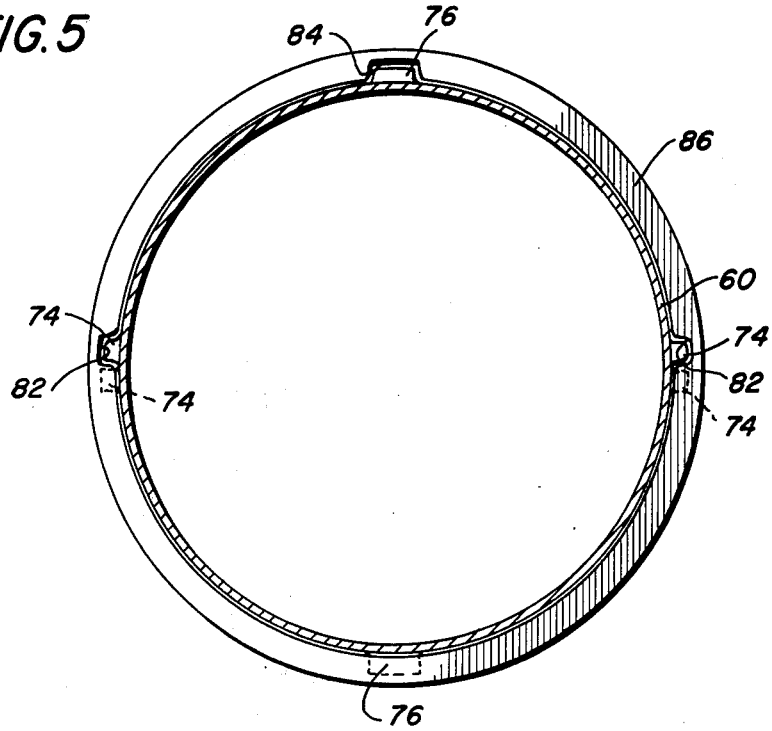
FIG. 5 is a view showing the relationship of the locating lugs and their corresponding locating channels.

Thus, as can be seen, the bottle 56 is closed when inserted into the neck 80 of the receiver and cannot be opened until it is locked into place within the neck 80. Conversely, the bottle cannot be removed from the neck 80 until the outlet opening 68 has been fully closed which corresponds to the position where the locating lugs 74 and 76 are in alignment with the locating channels 82 and 84. The relative positions of the lugs are shown in FIG. 5. The two smaller lugs 74 are located above the centerline which is perpendicular to the centerline running through the centerline of the larger lug. Thus, when the bottle is rotated 180°, the lugs will be in the position indicated by the dotted lines. Thus, the bottle can only be removed from the receiver when it has been fully closed; there is no possibility of the bottle being removed while still partially open.

Figure 4:
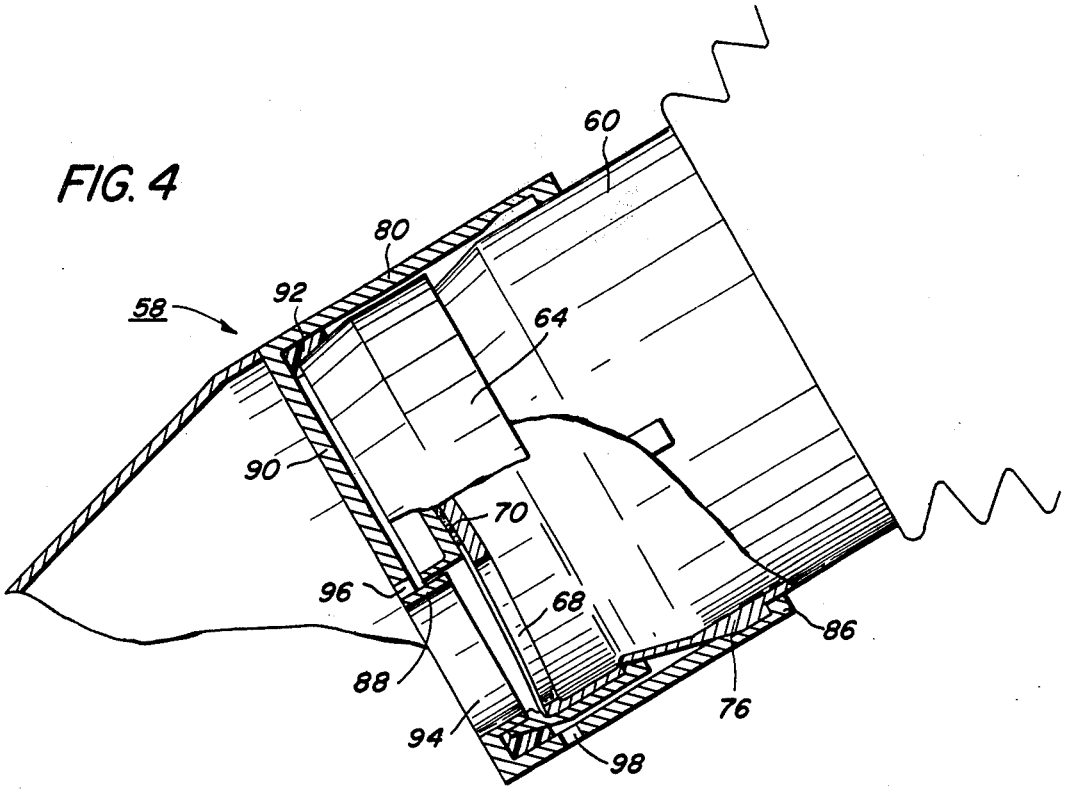
FIG. 4 is a cross-sectional view taken through the neck of the receiver and the bottle showing the bottle locked into position in its fully open position.

It should also be noted (see FIG. 4) that the D-shaped seal 70 located on the inner convex surface of the dispensing cap 64 serves to provide a very efficient seal. This seal surrounds the D-shaped outlet opening 68 in the toner bottle when the bottle is closed thus preventing any toner from escaping from the bottle. When the body 60 is rotated with respect to the dispensing cap 64, however, very little torque is required to rotate the bottle since there is a constant gap between the inner surface of the dispensing cap 64 and the end surface of the bottle.

Thus, as stated above, the present invention provides for a "white glove" operation, i.e., it permits an operator to add toner to a toner hopper without contaminating either the operator or internal machine parts. In addition, the bottle 56 can only be inserted into the receiver 58 in one position and cannot be removed from the receiver until the bottle has been fully closed. Conversely, the bottle cannot be opened after insertion until it has been locked into place within the receiver 58. Thus, there is no danger of spilling toner on internal machine parts. Also in the event that the toner hopper is filled before the toner bottle 56 has been emptied, no damage is done; the toner bottle must be closed before it can be removed from the neck 80 of the receiver 58, and any excess powder within the neck will drain through the openings 96 and 98 into the toner hopper 37 since the neck is inclined downwardly.

While the invention has been described with reference to the structure disclosed, it is not confined to the details set forth, but is intended to cover such modifications or changes as may come within the scope of the following claims.

What is claimed is:

1. Improved apparatus for adding toner to a toner hopper in an electrostatic reproduction machine wherein the improvement comprises:

a. a toner bottle including a body and a cap, the body having one end with an opening formed therein, the cap having an opening formed therein, and means for rotatably mounting the cap onto the one end of the body so that the opening in the cap can be rotated into and out of general alignment with the opening in the body;

b. means defining an inlet opening through which toner can be added to the hopper, the inlet opening conforming generally in size and shape to the opening in the one end of the body;

c. a lip surrounding the inlet opening and conforming generally in size and shape to both the inlet opening and the opening in the cap, the lip being adapted to mate with the opening in the cap to hold the latter in a stationary position while the body is rotated to bring the opening in the body into general alignment with both the opening in the cap and the inlet opening; and d. means for stopping the rotation of the body when all of the openings are generally aligned.

2. Improved apparatus according to claim 1, and further including means for simultaneously locking the bottle onto the hopper as the body is being rotated to bring the opening in the latter into general alignment with the opening in the cap, and for preventing the bottle from being removed from the hopper until the latter openings have been moved out of alignment.

3. Improved apparatus according to claim 2, wherein at least a portion of the body is formed of resilient material as a bellows which can be compressed to expel toner from the bottle.

4. Improved apparatus according to claim 3, which includes:

1. an annular neck surrounding and extending outwardly from the inlet opening, the inner diameter of the neck being approximately the same dimension as the outer diameter of the cap, and
2. means for draining any excess toner remaining around the inlet opening within the neck into the hopper.

5. An improved method for adding toner to a toner hopper in an electrostatic reproduction machine by moving the tone from a toner bottle through an outlet opening in one end of the toner bottle and through an inlet opening in the toner hopper, wherein the improvement comprises the steps of:

a. positioning the one end of the bottle in a predetermined position over the inlet opening in the hopper;

b. rotating a portion of the bottle to simultaneously open the outlet opening and lock the bottle onto the hopper;

c. stopping the rotation of the bottle portion when the openings are aligned and the outlet opening is completely opened by rotating the bottle portion until a lug on the bottle portion contacts a lug on the toner hopper; and d. compressing the bottle to expel toner through the aligned openings.

* * * * *